US008622786B2

(12) United States Patent
Bower et al.

(10) Patent No.: US 8,622,786 B2
(45) Date of Patent: Jan. 7, 2014

(54) INTERCHANGEABLE SANDING SYSTEM

(75) Inventors: Wayne Bower, Wilmette, IL (US); Mark Good, Cary, IL (US); Dan Swanson, Lombard, IL (US)

(73) Assignee: Sears Brands, L.L.C., Hoffman Estates, IL (US)

( * ) Notice: Subject to any disclaimer, the term of this patent is extended or adjusted under 35 U.S.C. 154(b) by 782 days.

(21) Appl. No.: 12/634,786

(22) Filed: Dec. 10, 2009

(65) Prior Publication Data

US 2010/0151774 A1 Jun. 17, 2010

Related U.S. Application Data

(60) Provisional application No. 61/121,433, filed on Dec. 10, 2008.

(51) Int. Cl.
*B24B 23/00* (2006.01)

(52) U.S. Cl.
USPC ..... 451/352; 451/350; 451/355

(58) Field of Classification Search
USPC ..... 451/344, 350, 352, 355, 358
See application file for complete search history.

(56) References Cited

U.S. PATENT DOCUMENTS

| | | | | |
|---|---|---|---|---|
| 3,643,385 | A * | 2/1972 | Mikiya | 451/355 |
| 3,648,413 | A * | 3/1972 | Godwin et al. | 451/358 |
| 4,178,723 | A * | 12/1979 | Fleckenstein et al. | 451/355 |
| 5,083,839 | A * | 1/1992 | Younger | 299/39.8 |
| 5,567,197 | A * | 10/1996 | Evensen | 451/358 |
| 5,662,515 | A * | 9/1997 | Evensen | 451/59 |
| 6,213,694 | B1 * | 4/2001 | Ichikawa | 409/139 |
| 6,336,852 | B1 * | 1/2002 | Roos | 451/352 |
| 6,790,134 | B2 * | 9/2004 | Swaddle et al. | 451/355 |
| 6,932,680 | B1 * | 8/2005 | Collins | 451/69 |
| 7,381,117 | B2 * | 6/2008 | Barous | 451/352 |
| 8,007,345 | B2 * | 8/2011 | Onose et al. | 451/297 |
| 8,152,602 | B2 * | 4/2012 | Guth | 451/456 |
| 2002/0009962 | A1 * | 1/2002 | Swaddle et al. | 451/355 |
| 2002/0177393 | A1 * | 11/2002 | Lang et al. | 451/355 |
| 2003/0040265 | A1 * | 2/2003 | Palushi | 451/350 |
| 2005/0272357 | A1 * | 12/2005 | Walker | 451/355 |

* cited by examiner

*Primary Examiner* — Eileen P. Morgan
(74) *Attorney, Agent, or Firm* — McAndrews, Held & Malloy, Ltd.

(57) ABSTRACT

An embodiment of the present invention is directed to a multi-purpose sanding system. The sanding system includes a motor, a drive mechanism in mechanical communication with the motor, and a plurality of interchangeable sanding devices. Each of the interchangeable sanding devices is interchangeably coupleable with the drive mechanism.

14 Claims, 5 Drawing Sheets

INTERCHANGEABLE SANDING SYSTEM

RELATED APPLICATION INFORMATION

This application claims the benefit of U.S. Provisional Patent Application No. 61/121,433, filed on Dec. 10, 2008.

BACKGROUND

1. Field

Embodiments of the present invention generally relate to the field of power tools.

2. Background

In the power tool field, various types of sanding apparatuses such as power belt sanders, power drum sanders, and power rasps are all known. For example, U.S. Pat. Nos. 7,410,412, 7,381,118, 7,338,348. 7,235,005, 7,179,158, and 7,083,508—the disclosures of which are hereby expressly incorporated within—each disclose examples of conventional belt sanders.

However, there currently does not exist a single power tool that is capable of performing the functions of a belt sander, a drum sander, and a rasp. Thus, a craftsman who is in need of all three functionalities must separately purchase a conventional belt sander, a conventional drum sander, and a conventional power rasp. Not only is this costly from a monetary perspective, but it is also costly from a storage perspective.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

An embodiment of the present invention is directed to a multi-purpose sanding system. The sanding system includes a motor, a drive mechanism in mechanical communication with the motor, and a plurality of interchangeable sanding devices. Each of the interchangeable sanding devices is interchangeably coupleable with the drive mechanism.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, and components have not been described in detail as not to unnecessarily obscure aspects of the present invention.

Generally speaking, embodiments provide for an interchangeable, multi-purpose sanding system that allows a single- or variable-speed handheld sanding apparatus to interchangeably serve as multiple sanding tools. The multiple sanding tools may include, but are not limited to, a belt sander, a drum sander, and a power rasp.

Figure 1:
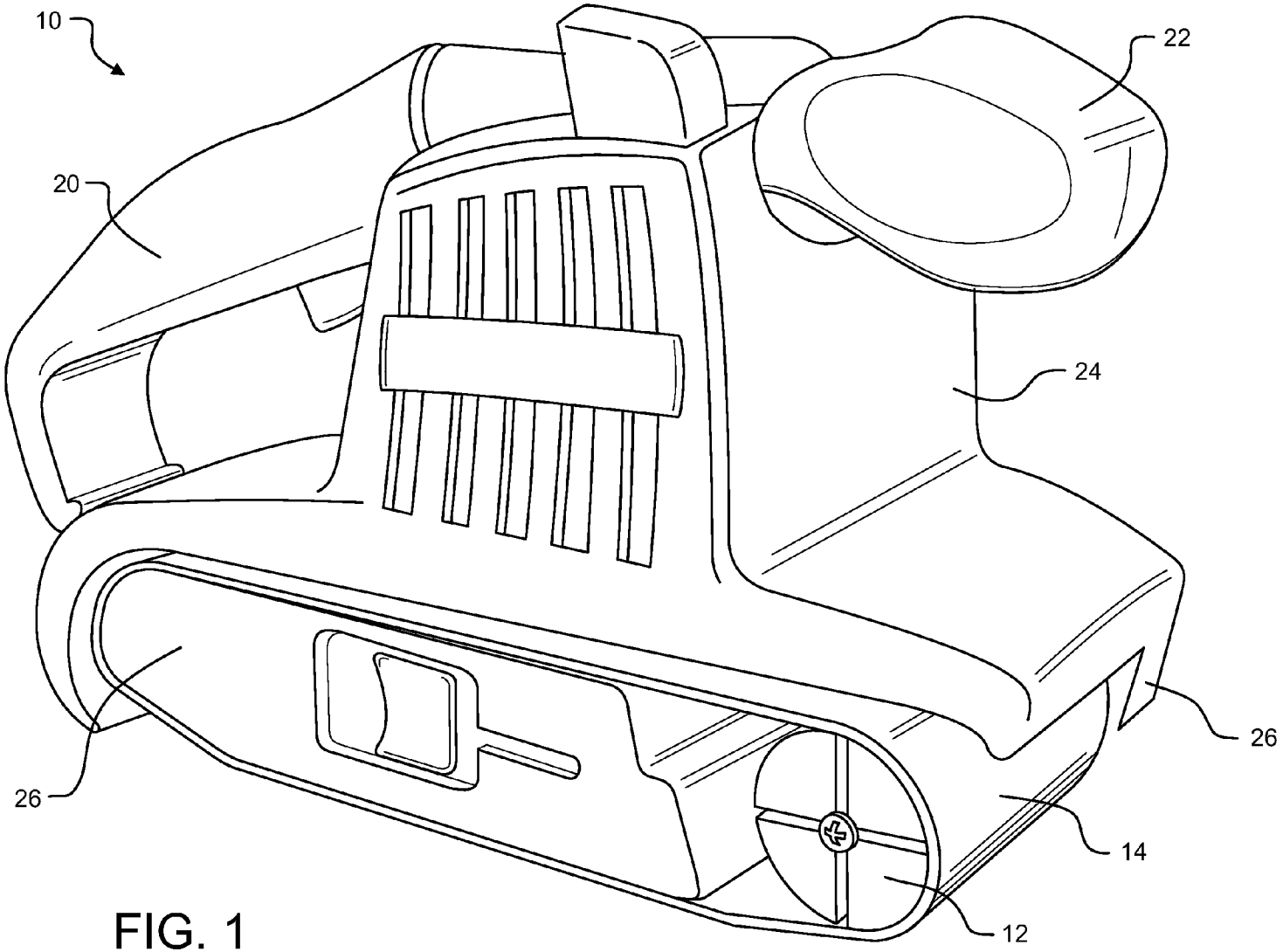
FIG. 1 is an isometric view of a sanding apparatus including an interchangeable sanding device that is a belt sander roller, in accordance with an embodiment of the present invention.

FIG. 1 illustrates a sanding apparatus 10 in accordance with an embodiment that has been configured as a belt sander. Generally, the sanding apparatus includes a motor housing 24 having a motor disposed therein, a front handle 22 and a rear handle 20. The motor is operable to drive a drive mechanism. In one embodiment, the drive mechanism includes a drive cylinder 12, which enables the drive mechanism to translate power from the motor into rotational motion of the drive cylinder 12. The drive cylinder 12 is operable to couple with and drive a plurality of sanding devices, including a sanding belt 14 and/or a plurality of interchangeable drums. In one embodiment, the drive mechanism is coupled to one end of the drive cylinder, while permitting the sanding belt 14 or interchangeable drum to be slid over or removed from the other end of the drive cylinder 12. The drive mechanism may additionally or alternatively incorporate a solid shaft, a compressible rubber cylinder, a pneumatic cylinder, splines, keys, or the like.

In the illustrated embodiment of FIG. 1, the drive cylinder 12 serves as a belt sander roller, which is in frictional contact with a sanding loop 14. Thus, the drive mechanism causes the drive cylinder 12 to rotate, thereby also causing the sanding loop 14 to also rotate. The sanding apparatus may also include one or more substantially permanently mounted and freely rotatable rollers, for example, at location 26. Accordingly, in the configuration depicted in FIG. 1, the sanding apparatus 10 may be used as a belt sander.

Figure 2A:
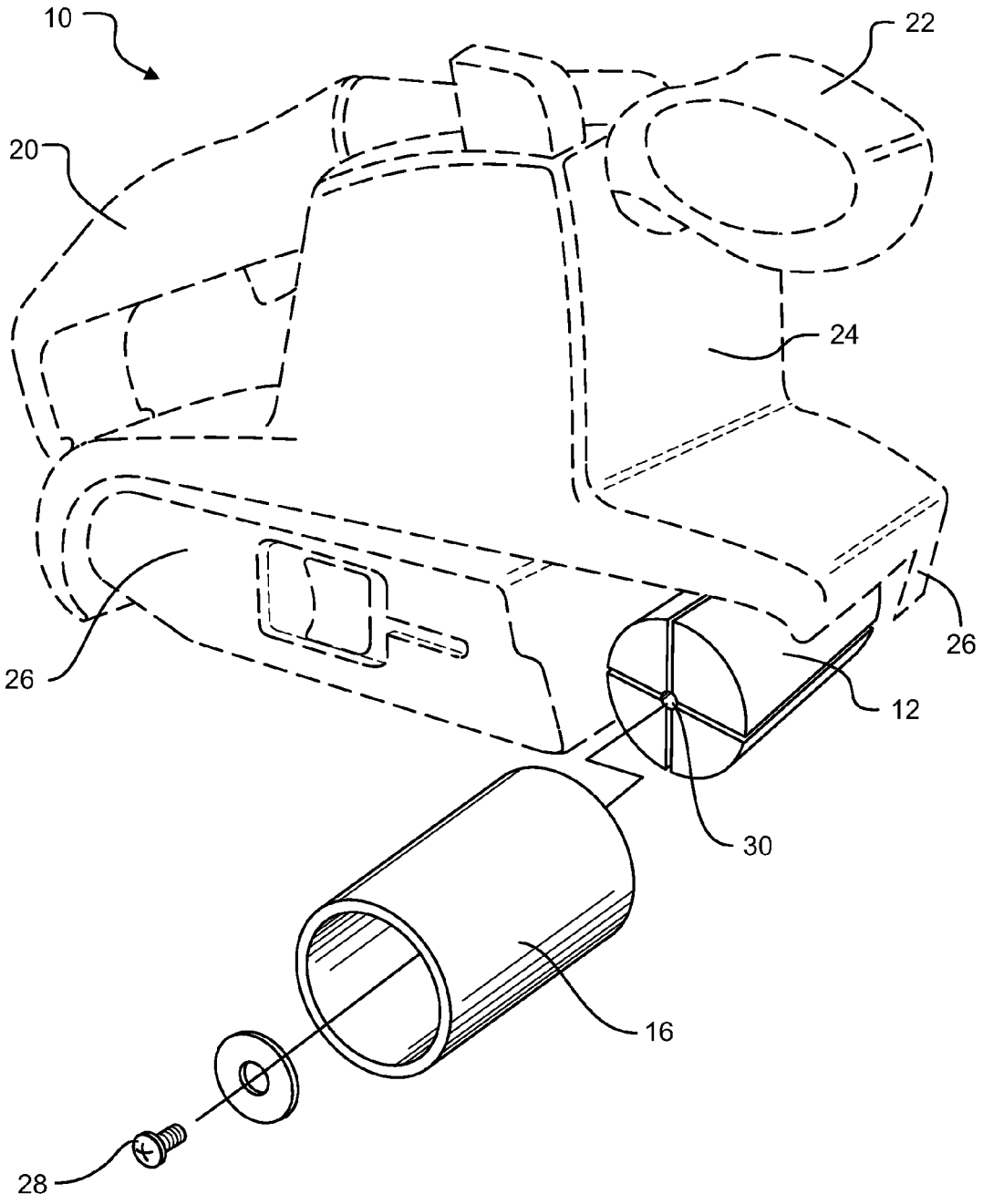
FIG. 2A is an isometric view of a sanding apparatus including an interchangeable sanding device that is a sander drum, wherein the rasp drum is not attached to the sanding apparatus, in accordance with an embodiment of the present invention.
Figure 2B:
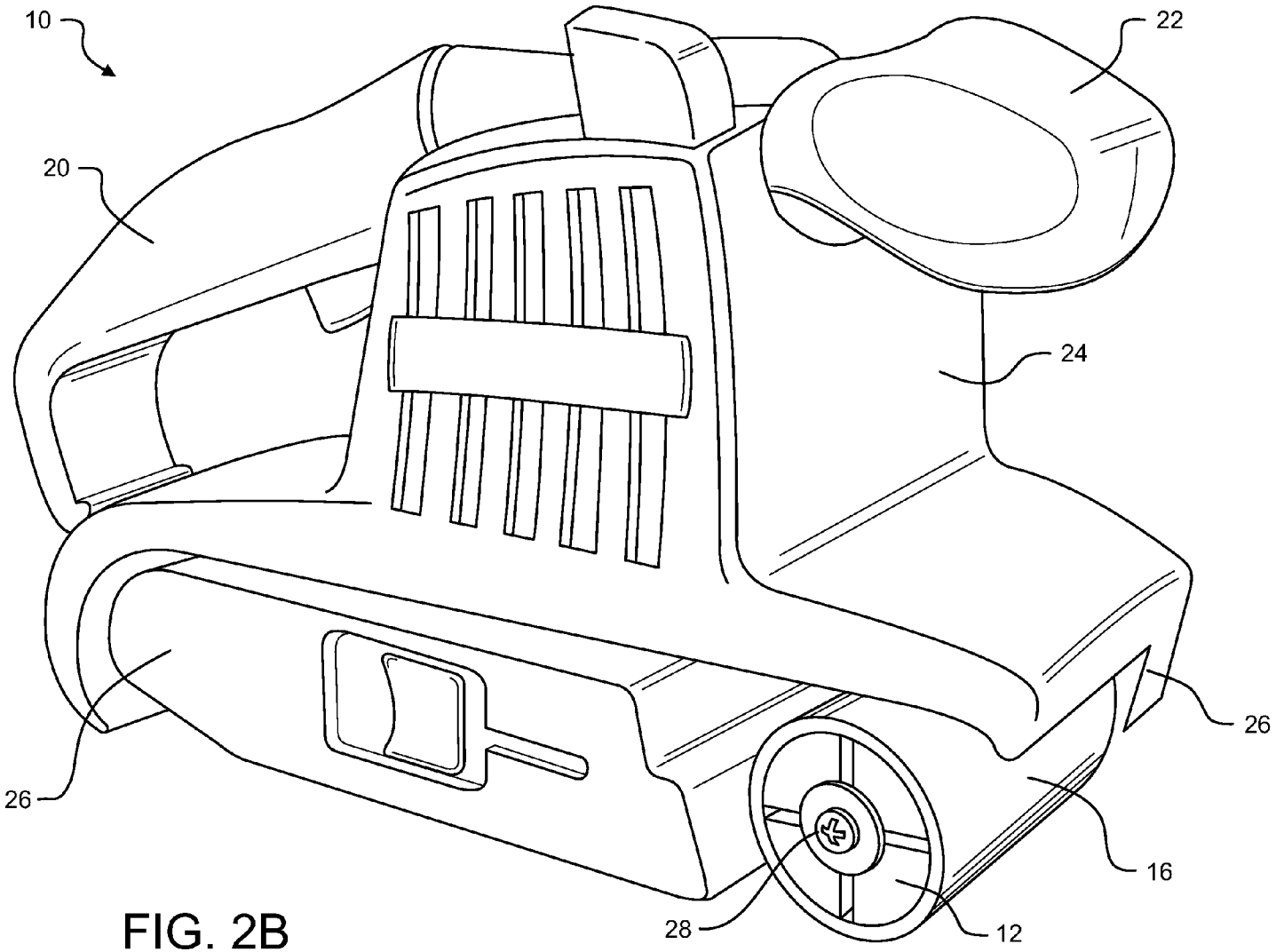
FIG. 2B is an isometric view of a sanding apparatus of FIG. 2A, wherein the sander drum is attached to the sanding apparatus, in accordance with an embodiment of the present invention.

The sanding loop 14 may be removed from the sanding apparatus 10 so that the sanding apparatus 10 may be reconfigured as another sanding tool. In the illustrated embodiment, for example, the drive cylinder 12 comprises an expandable mandrel. As shown in FIGS. 2A and 2B, a sanding drum 16 may be slid over and secured to the drive cylinder 12. Subsequently, bolt 28 may then be screwed into hole 30, which then causes the drive cylinder 12 to expand, thereby securing the sanding drum 16 into place. In such as configuration, the drive cylinder 12 causes the sanding drum 16 to rotate. Accordingly, in the configuration depicted in FIG. 2B, the sanding apparatus 10 may be used as a drum sander.

Figure 3A:
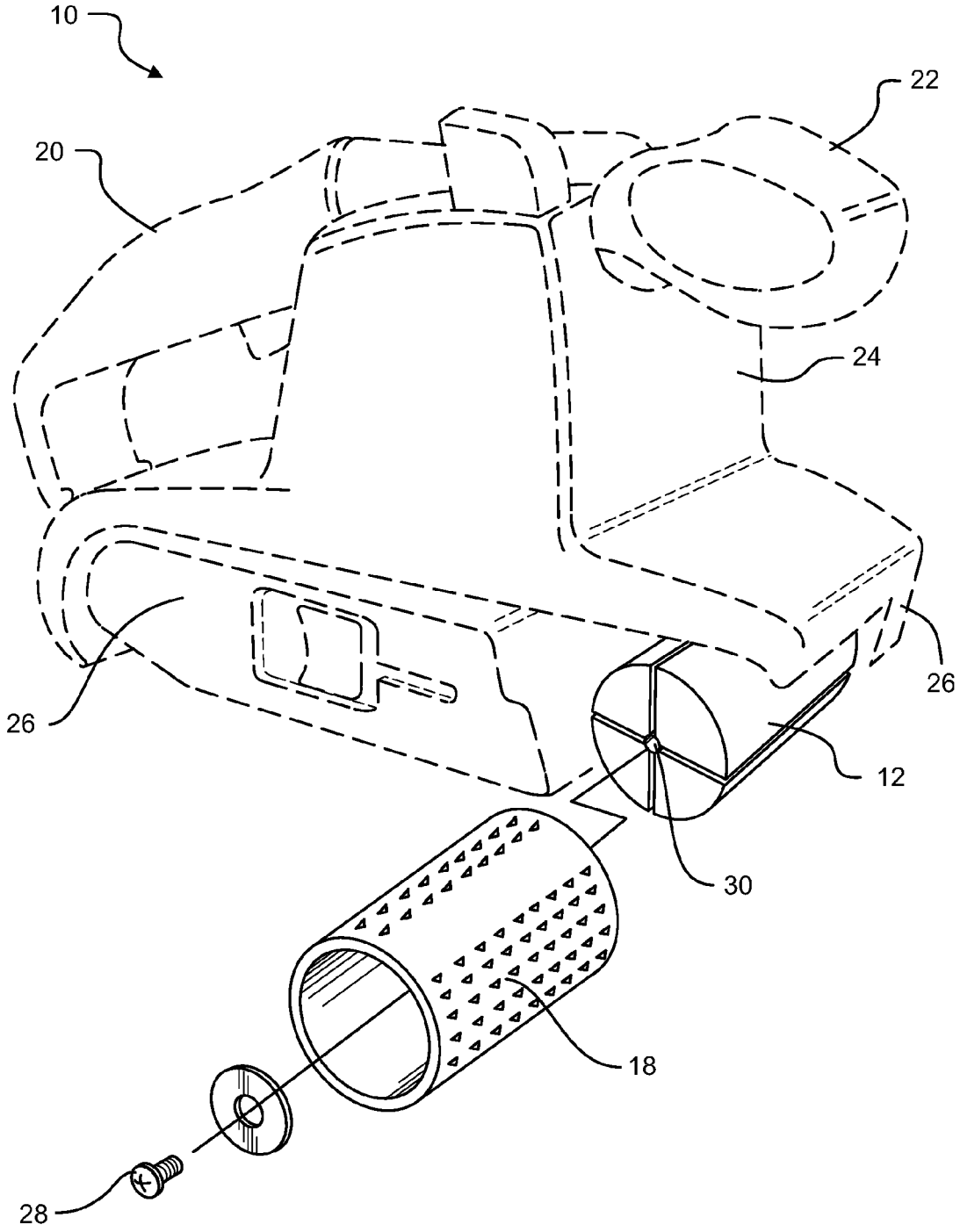
FIG. 3A is an isometric view of a sanding apparatus including an interchangeable sanding device that is a rasp drum, wherein the rasp drum is not attached to the sanding apparatus, in accordance with an embodiment of the present invention.
Figure 3B:
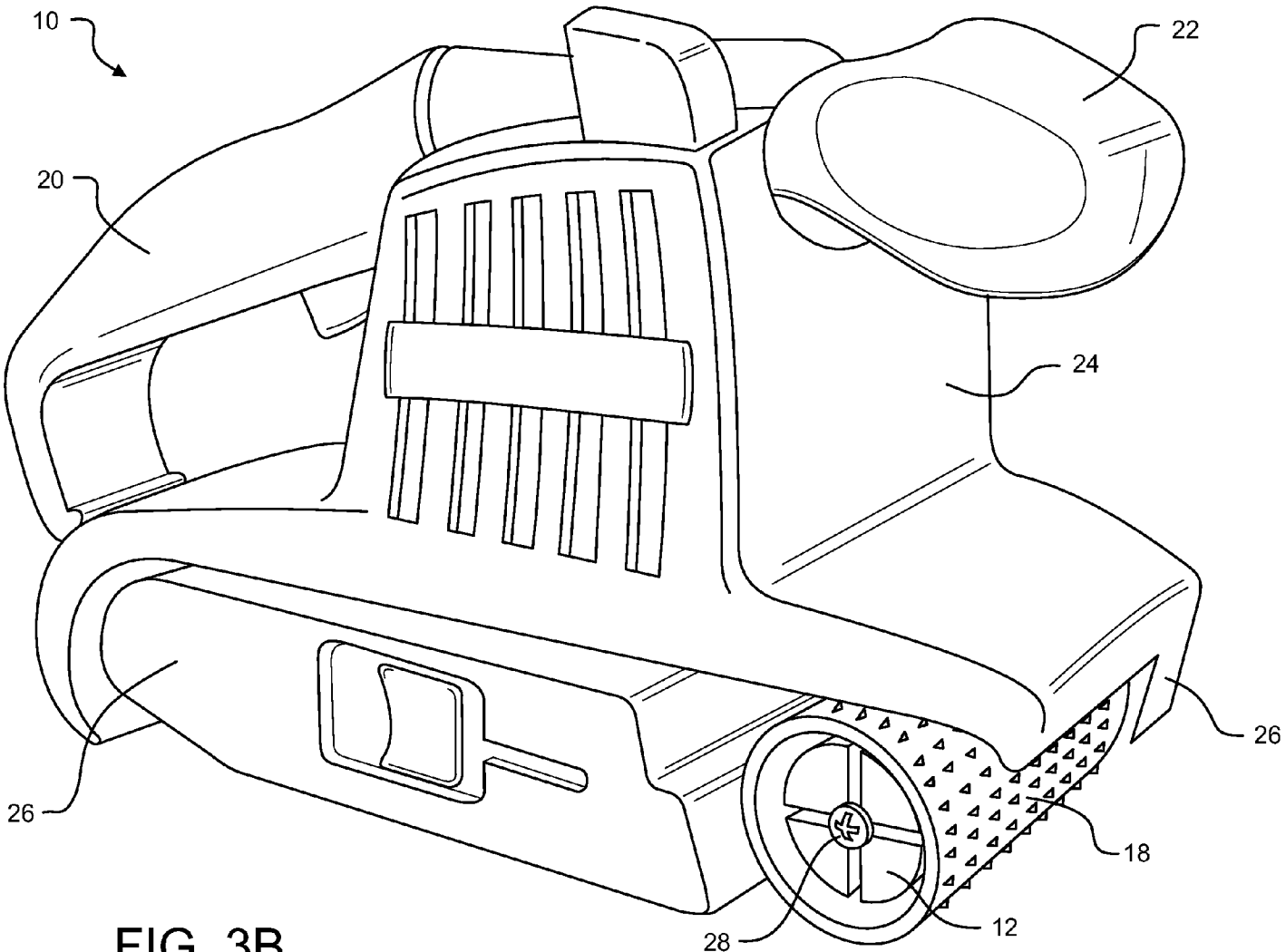
FIG. 3B is an isometric view of a sanding apparatus of FIG. 3A, wherein the rasp drum is attached to the sanding apparatus, in accordance with an embodiment of the present invention.

Similarly, the sanding drum 16 may be removed from the drive cylinder 12 (e.g. by loosening bolt 28) so that the sanding apparatus 10 may be re-configured as another sanding tool. As shown in FIGS. 3A and 3B, a rasp drum 18 may be slid over the drive cylinder 12 and secured into place (e.g. by tightening bolt 28). In such as configuration, the drive cylinder 12 causes the rasp drum 18 to rotate. Accordingly, in the configuration depicted in FIG. 3B, the sanding apparatus 10 may be used as a power rasp.

In addition to the illustrated expanding mandrel, the attachment and detachment of the interchangeable drums may be implemented in a number of other ways. For example, the drums and/or drive cylinder 12 may include a latch, cartridge, or other type of quick-connect mechanism to enable convenient connection to and disconnection from the drive mechanism.

Thus, embodiments provide for a hand-held sanding apparatus that may be re-configured into different sanding tools, such as a belt sander, a drum sander, and a power rasp. Such an apparatus according to various embodiments save a would-be purchaser the added cost of having to purchase two or more separate sanding apparatuses. Moreover, because only a single sanding apparatus is needed in order to perform multiple sanding operations, the sanding apparatus of various embodiments therefore provides improved portability over conventional sanding apparatuses.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A multi-purpose sanding system, comprising:
- a housing having a front end and an opposite rear end;
- a motor;
- a drive mechanism located at the front end of the housing and in mechanical communication with the motor;
- at least one freely rotatable roller located at the opposite rear end of the housing; and
- a plurality of interchangeable sanding devices comprising a sander drum and a sanding belt, each of the plurality of interchangeable sanding devices being interchangeably and independently coupleable with the drive mechanism, wherein the drive mechanism rotates the sander drum, and wherein the drive mechanism rotates the sanding belt around the drive mechanism and the at least one freely rotatable roller.

2. The multi-purpose sanding system as recited in claim 1, wherein the plurality of interchangeable sanding devices comprises a rasp drum.

3. The multi-purpose sanding system as recited in claim 1, wherein the drive mechanism includes a drive cylinder for coupling with and driving the interchangeable sanding devices.

4. The multi-purpose sanding system as recited in claim 3, wherein the drive cylinder comprises an expandable mandrel for permitting attachment and detachment of the interchangeable sanding devices.

5. The multi-purpose sanding system as recited in claim 4, wherein the expandable mandrel has an expanded configuration and a contracted configuration, wherein the expandable mandrel secures a selected one of the interchangeable sanding devices into position when in the expanded configuration and permits the selected one of the interchangeable sanding devices to be removed when in the contracted configuration.

6. The multi-purpose sanding system as recited in claim 3, wherein the drive cylinder comprises a latch for enabling attachment and detachment of one or more of the sanding devices.

7. A multi-purpose sanding system, comprising:
- a housing having a front end and an opposite rear end;
- a motor;
- a drive cylinder located at the front end of the housing and in mechanical communication with the motor;
- at least one freely rotatable roller located at the opposite rear end of the housing; and
- a plurality of interchangeable sanding devices, each of the plurality of interchangeable sanding devices being interchangeably and independently coupleable with the drive cylinder, wherein the plurality of interchangeable sanding devices include a sanding belt, a sander drum and a rasp drum, wherein the sanding belt is coupleable with both the drive cylinder and the at least one freely rotatable roller.

8. The multi-purpose sanding system as recited in claim 7, wherein the drive cylinder comprises an expandable mandrel for permitting attachment and detachment of the interchangeable sanding devices.

9. The multi-purpose sanding system as recited in claim 8, wherein the expandable mandrel has an expanded configuration and a contracted configuration, wherein the expandable mandrel secures a selected one of the interchangeable sanding devices into position when in the expanded configuration and permits the selected one of the interchangeable sanding devices to be removed when in the contracted configuration.

10. The multi-purpose sanding system as recited in claim 7, wherein the drive cylinder comprises a latch for enabling attachment and detachment of one or more of the sanding devices.

11. A multi-purpose sanding system, comprising:
- a housing having a front end and an opposite rear end;
- a motor;
- a drive mechanism in mechanical communication with the motor, the drive mechanism including a drive cylinder located at the front end of the housing;
- at least one freely rotatable roller located at the opposite rear end of the housing; and
- a plurality of interchangeable sanding devices comprising a sanding belt, a sander drum and a rasp drum,
- wherein the sanding belt is coupleable with the at least one freely rotatable roller and the drive cylinder, wherein the drive cylinder rotates the sanding belt around the drive cylinder and the at least one freely rotatable roller,
- wherein each of the sanding drum and the rasp drum is interchangeably coupleable with and driven by the drive cylinder.

12. The multi-purpose sanding system as recited in claim 11, wherein the drive cylinder comprises an expandable mandrel for permitting attachment and detachment of the interchangeable sanding devices.

13. The multi-purpose sanding system as recited in claim 11, wherein the expandable mandrel has an expanded configuration and a contracted configuration, wherein the expandable mandrel secures a selected one of the interchangeable sanding devices into position when in the expanded configuration and permits the selected one of the interchangeable sanding devices to be removed when in the contracted configuration.

14. The multi-purpose sanding system as recited in claim 11, wherein the drive cylinder comprises a latch for enabling attachment and detachment of one or more of the sanding devices.

* * * * *

UNITED STATES PATENT AND TRADEMARK OFFICE

CERTIFICATE OF CORRECTION

PATENT NO. : 8,622,786 B2
APPLICATION NO. : 12/634786
DATED : January 7, 2014
INVENTOR(S) : Bower et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 877 days.

Signed and Sealed this
Twenty-sixth Day of May, 2015

Michelle K. Lee

Michelle K. Lee
*Director of the United States Patent and Trademark Office*